US006082444A

United States Patent [19]

Harada et al.

[11] Patent Number: 6,082,444

[45] Date of Patent: Jul. 4, 2000

[54] HEATING TUBE FOR BOILERS AND METHOD OF MANUFACTURING THE SAME

[75] Inventors: Yoshio Harada, Hyogo; Tatsuyuki Kimura, Ibaraki; Akio Shiratori, Ibaraki; Morio Yokobori, Ibaraki, all of Japan

[73] Assignee: Tocalo Co., Ltd., Hyogo, Japan

[21] Appl. No.: 09/147,154

[22] PCT Filed: Aug. 20, 1997

[86] PCT No.: PCT/JP97/02898

§ 371 Date: Oct. 20, 1998

§ 102(e) Date: Oct. 20, 1998

[87] PCT Pub. No.: WO98/37253

PCT Pub. Date: Aug. 27, 1998

[30] Foreign Application Priority Data

Feb. 21, 1997 [JP] Japan ..... 9-038100

[51] Int. Cl.[7] ..... F28F 13/18

[52] U.S. Cl. ..... 165/133; 905/134.1; 427/422

[58] Field of Search ..... 165/133, 905, 165/134.1, 181; 148/24; 29/527.2

[56] References Cited

U.S. PATENT DOCUMENTS

| | | | |
|---|---|---|---|
| 3,587,730 | 6/1971 | Milton | 165/133 |
| 3,595,310 | 7/1971 | Burne | 165/181 |
| 3,689,987 | 9/1972 | Teague | 29/527.2 |
| 3,990,862 | 11/1976 | Dahl et al. | 165/133 |
| 4,093,755 | 6/1978 | Dahl et al. | 165/133 |
| 5,732,767 | 3/1998 | Saperstein | 165/134.1 |
| 5,820,698 | 10/1998 | Tohma et al. | 148/24 |
| 5,833,931 | 11/1998 | Fromson et al. | 165/133 |
| 5,857,266 | 1/1999 | Raybyould et al. | 165/133 |
| 5,894,054 | 4/1999 | Paruchuri et al. | 165/905 |
| 5,907,761 | 5/1999 | Tohma et al. | 165/133 |

FOREIGN PATENT DOCUMENTS

| | | |
|---|---|---|
| 54-115624 | 9/1979 | Japan . |
| 60-142103 | 7/1985 | Japan . |
| 61-41756 | 2/1986 | Japan . |
| 61-210171 | 9/1986 | Japan . |
| 62-112768 | 5/1987 | Japan . |
| 2-44103 | 2/1990 | Japan . |
| 2-185961 | 7/1990 | Japan . |
| 2-282461 | 11/1990 | Japan . |
| 5-65618 | 3/1993 | Japan . |
| 7-6977 | 1/1995 | Japan . |
| 7-18529 | 3/1995 | Japan . |
| 8-92719 | 4/1996 | Japan . |
| 8-311633 | 11/1996 | Japan . |
| 9-75832 | 3/1997 | Japan . |

OTHER PUBLICATIONS

English Language Abstract of JP No. 61–41756.
English Language Abstract of JP No. 60–142103.English Language Abstract of JP No. 2–185961.

(List continued on next page.)

*Primary Examiner*—Ira S. Lazarus
*Assistant Examiner*—Terrell McKinnon
*Attorney, Agent, or Firm*—Greenblum & Bernstein, P.L.C.

[57] ABSTRACT

In order to control the precipitation and formation of a deposition produced in an inner face portion of a heat transmitting tube for a boiler due to a boiler water and the formation of an oxide scale of a tube material due to overheated steam, there is provided a heat transmitting tube for a boiler provided with a porous sprayed coating. The porous sprayed coating is formed by using a metal·alloy having excellent high temperature oxidation resistance and corrosion resistance at high temperature as compared with a material of the heat transmitting tube onto an outer heat receiving surface for contacting a combustion gas, and optionally an oxide ceramic, and optionally an oxide cermet. Solid inorganic sintered fin particles are penetrated and filled in opening pores of the porous sprayed coating and form a heat shielding layer on the surface of the porous sprayed coating. The solid inorganic sintered fine particles are solidified at high melting point to produce a heat shielding function to thereby prevent excessive heat flow to the heat transmitting tube.

21 Claims, 2 Drawing Sheets

OTHER PUBLICATIONS

English Language Abstract of JP No. 62–64952 (family member of JP No. 7–6977).
English Language Abstract of JP No. 62–184103 (family member of JP No. 7–18529).
English Language Abstract of JP No. 8–311633.
English Language Abstract of JP No. 8–92719.
English Language Abstract of JP No. 5–65618.
English Language Abstract of JP No. 62–112768.
English Language Abstract of JP No. 61–210171.
English Language Abstract of JP No. 54–115624.
English Language Abstract of JP No. 2–44103.
English Language Abstract of JP No. 2–282461.
English Language Abstract of JP No. 9–75832.

HEATING TUBE FOR BOILERS AND METHOD OF MANUFACTURING THE SAME

TECHNICAL FIELD

This invention relates to a heat transmitting tube for a boiler having excellent adhesion controlling effect of depositions produced in the heat transmitting tube (solid substances precipitated when ingredients dissolved in a boiler water are boiled and evaporated in the tube) and a method of manufacturing the same, and more particularly it proposes a heat transmitting tube for a boiler which inhibits growth of depositions adhered onto an inner face of an evaporation tube in the boiler using a heavy oil such as heavy oil, residual oil produced in a petroleum chemical process, petroleum coke, asphalt or the like as a fuel.

BACKGROUND ART

The heat transmitting tube for the boiler is manufactured so as to efficiently contact with combustion gas of fossil fuel or high temperature process gas. For this end, the heat transmitting tube frequently contacts with various corrosive impurities contained in the gas such as sulfur oxide (SOx) and nitrogen oxide (NOx), or vanadium compounds ($V_2O_5$, $NaVO_3$, $Na_2O.V_2O_5$ and the like) and sulfur compounds ($Na_2SO_4$, $K_2SO_4$ and the like) included as a combustion ash content, and so on and hence is liable to be chemically damaged. Particularly, the heat transmitting tube for the boiler burning a heavy oil fuel containing the vanadium compound and the sulfur compound is considerably worn out by accelerated oxidation corrosion resulting from the vanadium compound and sulfurization corrosion of the sulfur compound. These corrosion damages are called gas-side corrosion because they are created at the outer surface of the heat transmitting tube or a position contacting the combustion gas.

As a method of preventing gas-side corrosion, there has hitherto been proposed a method of forming protective coatings on the surface of the heat transmitting tube as mentioned below.

(1) In JP-A-61-41756 is disclosed a technique in which Ni—Cr alloy or self fluxing alloy is sprayed onto the surface of the heat transmitting tube for a fluidized bed type boiler burning coke and then fused by heating to impart heat resistance and abrasion resistance to the heat transmitting tube.

(2) In JP-A-60-142103 is disclosed a technique a self fluxing alloy coating is formed on the surface of the heat transmitting tube for a boiler covering waste heat in a dry type fire extinguishing device and fused by heating and further subjected to a solid solution treatment or an annealing treatment to prevent erosion.

The above two techniques are effective in boilers used under an environment in which the abrasion rate is larger than the corrosion rate.

(3) In JP-A-2-185961 is disclosed a technique in which Al is coated onto the surface of the heat transmitting tube for the boiler by spraying and a self fluxing alloy sprayed coating containing Al is formed thereon and then fused by heating to impart corrosion resistance to the heat transmitting tube.

(4) In JP-B-7-6977 and JP-B-7-18529 is disclosed the formation of a sprayed coating on the heat transmitting tube for the boiler.

As the corrosion damage created in the boiler, there is a water-side corrosion observed in an inner wall face of the heat transmitting tube or a surface passing a boiler water or an overheated steam therethrough in addition to the above gas-side corrosion. In general, the boiler water is usually adjusted to an alkalinity for controlling the above water-side corrosion. Therefore, as the operation of the boiler is continued over a long time period, an alkali component contained in the boiler water locally concentrates at the inner wall face of the heat transmitting tube and hence the tube material is corroded to produce an iron oxide. And also, compounds of Si, Ca, Mg, P, Cu and the like slightly contained in the boiler water precipitate on the inner wall face of the tube. As a result, obstruction of heat transmission is caused but also a phenomenon such as local overheating or the like is caused, and the heat transmitting tube is sometimes broken by these causes.

These phenomena are created in a portion of an evaporation tube producing steam by boiling of the boiler water. This portion is a neighborhood of a fuel combustion region having a greatest heat loading in view of the boiler structure. As seen from the above explanation, the position generating the corrosion damage due to the boiler water is restricted to a side that the heat transmitting tube for the boiler is always subjected to heat loading, while there is no problem in an opposite side not being exposed to the combustion gas.

As mentioned above, the conventional heat transmitting tube for the boiler, particularly the evaporation tube portion has the following problems.

(1) Since the heat loading in the inner wall face of the evaporation tube is high, alkali component in the boiler water is concentrated to cause thickness reduction through corrosion of the inner wall face of the tube.

(2) At a portion violently evaporating water under a high heat loading, components dissolved in the boiler water such as Ca, Mg, Si, Fe, P, Cu and the like are precipitated to ununiformly adhere and deposit onto the inner wall face of the tube.

(3) The substance adhered onto the inner wall face of the tube is poor in the thermal conductivity, so that temperature of the inner wall face in the tube facing the combustion gas (heat transmitting face) abnormally rises and hence the formation of oxide scale is promoted or the breakage of the tube is induced.

(4) When a substance precipitated onto the inner wall face of the tube or deposition grows large, it is apt to be locally peeled off therefrom. As a result, the boiling of water becomes violent in the peeled portion, which promotes the phenomena of the above items (1), (2). Therefore, corrosion through alkali component locally progresses to wear out the tube wall.

(5) When the peeling of the deposition is at a half-finished state or when a crack is caused in the deposition, the boiler water penetrated is immediately rendered into steam. Since steam is very low in the thermal conductivity as compared with water, the inner wall face of the tube is locally over-heated and hence cracks are created in the heat transmitting tube itself to sometimes bring about breakage.

It is, therefore, a main object of the invention to propose a technique of controlling the adhesion of the deposition onto the inner wall face of the heat transmitting tube for the boiler.

It is another object of the invention to propose a technique of mitigating heat loading in the heat transmitting tube for the boiler to prevent corrosion in the inner wall of the tube.

It is another object of the invention to propose a surface coating material of a heat transmitting tube for the boiler effective for mitigating corrosion through alkali component in the boiler water and preventing local over-heating.

It is a still further object of the invention to propose a technique of forming a sprayed coating for improving a service life of a heat transmitting tube for the boiler.

It is another object of the invention to propose a method of forming a sprayed coating effective for mitigating heat loading in an outer surface of a heat transmitting tube for the boiler and a method of manufacturing the heat transmitting tube for the boiler having an excellent effect of controlling the adhesion of the deposition.

DISCLOSURE OF THE INVENTION

The inventors have concluded that the following means is effective for solving the aforementioned problems and realizing the above objects.

That is, the invention lies in a heat transmitting tube for a boiler, characterized in that a heat transmitting surface of the tube contacting combustion gas is coated with a porous sprayed coating, and the sprayed coating is provided with a heat shielding layer formed by impregnating pores of the coating with inorganic sintered fine particles consisting essentially of a vanadium compound and a sulfur compound and covering a surface of the coating therewith.

In the invention, the porous sprayed coating is preferable to be formed by subjecting a metal·alloy having excellent high temperature oxidation resistance and corrosion resistance at high temperature such as Cr steel, Ni—Cr steel or the like as compared with a material of the heat transmitting tube to thermal spraying at a coating thickness of 30–1000 $\mu$m and a porosity of 2–20%.

In the invention, the porous sprayed coating is preferably a composite coating having a thickness of 100–1000 $\mu$m and a porosity of 2–20% and comprising an undercoat formed by thermal spraying of the metal·alloy having excellent high temperature oxidation resistance and corrosion resistance at high temperature as compared with a material of the heat transmitting tube and a topcoat thermally sprayed onto the undercoat and made of at least one oxide ceramic or oxide cermet selected from $ZrO_2$, $Al_2O_3$, $SiO_2$, MgO, $TiO_2$ and $Y_2O_3$.

In the invention, the porous sprayed coating is preferably to be a composite coating having a thickness of 100–1000 $\mu$m and a porosity of 2–20% and comprising an undercoat formed by thermal spraying of the metal·alloy having excellent high temperature oxidation resistance and corrosion resistance at high temperature as compared with a material of the heat transmitting tube, an overcoat thermally sprayed onto the undercoat and made of at least one oxide ceramic or oxide cermet selected from $ZrO_2$, $Al_2O_3$, $SiO_2$, MgO, $TiO_2$ and $Y_2O_3$ and a topcoat thermally sprayed thereonto and made of at least one oxide ceramic selected from $ZrO_2$, $Al_2O_3$, $SiO_2$, MgO, $TiO_2$ and $Y_2O_3$.

In the invention, the inorganic sintered fine particles preferably consist essentially of a vanadium compound such as $V_2O_5$, $Na_2VO_3$ and $Na_2O.V_2O_5$ and a sulfur compound such as $Na_2SO_4$ and $K_2SO_4$ and include a crust-forming component such as $SiO_2$, $Al_2O_3$, $TiO_2$ and $Fe_2O_3$ as an inevitable inclusion.

In the invention, it is favorable to use sintered fine particles of a solid combustion product, which is produced by concentration, precipitation or impinge adhesion when a fossil fuel is burnt in the boiler, as the inorganic sintered fine particles.

In the invention, the sintered fine particles of the solid combustion product are preferably a combustion ash in the boiler.

Further, the invention lies in a method of manufacturing a heat transmitting tube for a boiler having an excellent effect of controlling adhesion of deposition onto an inner wall face of the tube, which comprises thermally spraying a metal·alloy having excellent high temperature oxidation resistance and corrosion resistance at high temperature as compared with a material of the heat transmitting tube onto a heat transmitting surface mainly contacting a combustion gas to form a porous sprayed coating having a thickness of 30–1000 $\mu$m and a porosity of 2–20%, and then contacting a gas consisting essentially of a vanadium compound and a sulfur compound with the porous sprayed coating at a high temperature to form a heat shielding layer formed by impregnating pores of the coating with inorganic sintered fine particles consisting essentially of a vanadium compound such as $V_2O_5$, $Na_2VO_3$ and $Na_2O.V_2O_5$ and a sulfur compound such as $Na_2SO_4$ and $K_2SO_4$ and including NiO and a crust-forming component such as $SiO_2$, $Al_2O_3$, $TiO_2$ and $Fe_2O_3$ as an inevitable inclusion and covering a surface of the coating therewith.

In the invention, the porous sprayed coating is preferably a composite coating having a thickness of 100–1000 $\mu$m and a porosity of 2–20% formed by thermally spraying the metal·alloy having excellent high temperature oxidation resistance and corrosion resistance at high temperature as compared with a material of the heat transmitting tube and then thermally spraying thereonto at least one oxide ceramic or oxide cermet selected from $ZrO_2$, $Al_2O_3$, $SiO_2$, MgO, $TiO_2$ and $Y_2O_3$.

In the invention, the porous sprayed coating is preferably a composite coating having a thickness of 100–1000 $\mu$m and a porosity of 2–20% formed by thermally spraying the metal·alloy having excellent high temperature oxidation resistance and corrosion resistance at high temperature as compared with a material of the heat transmitting tube, and then thermally spraying thereonto at least one oxide ceramic or oxide cermet selected from $ZrO_2$, $Al_2O_3$, $SiO_2$, MgO, $TiO_2$ and $Y_2O_3$ and further thermally spraying thereonto at least one oxide ceramic selected from $ZrO_2$, $Al_2O_3$, $SiO_2$, MgO, $TiO_2$ and $Y_2O_3$.

Further, in the invention, the heat shielding layer of the sprayed coating is preferably formed by contacting combustion gas in the boiler with the sprayed coating to invade and solidify concentration component and fine particulate combustion ash included in the combustion gas in the pores of the coating and adhere them to the surface of the coating.

BEST MODE FOR CARRYING OUT THE INVENTION

Figure 1:
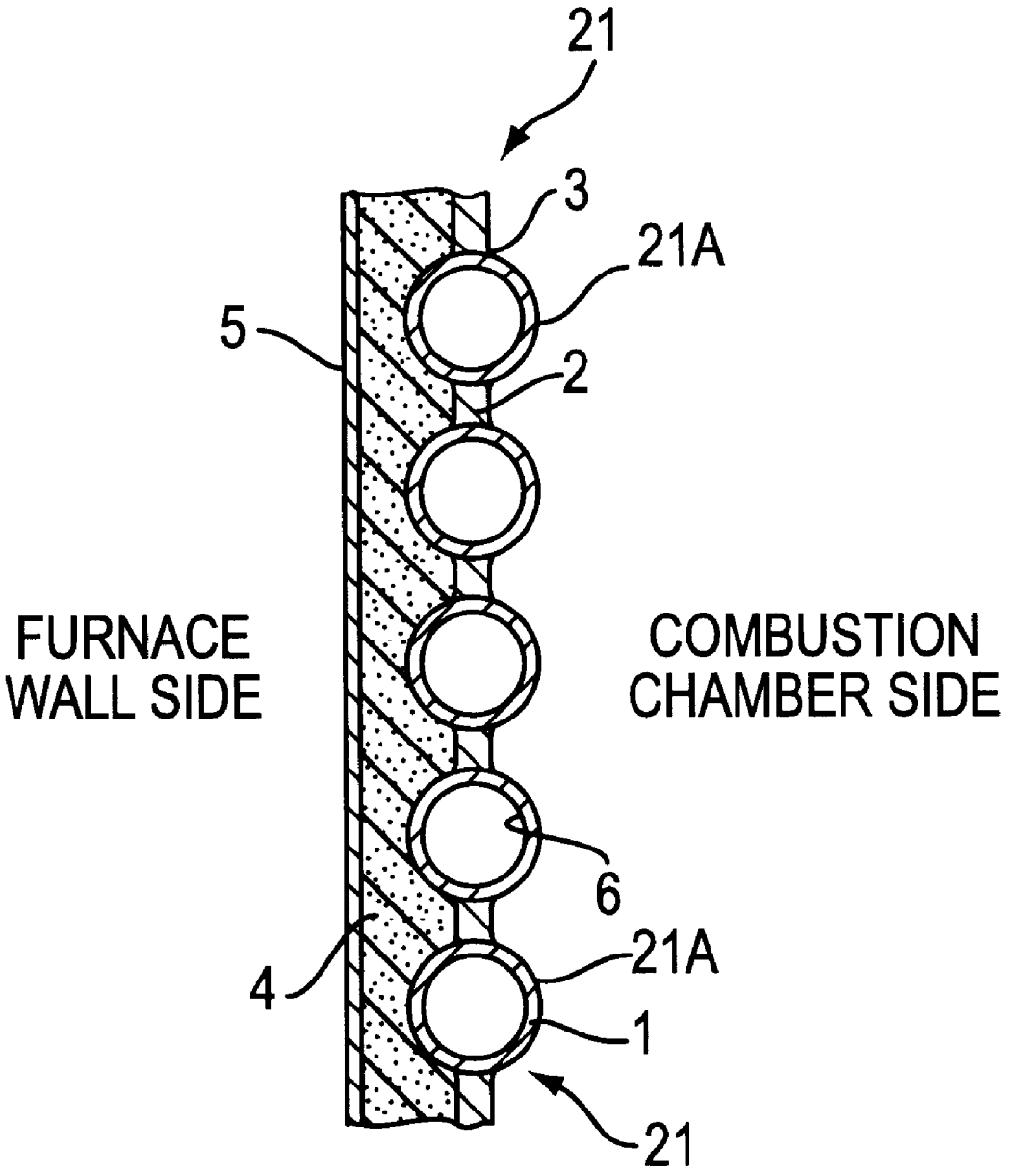
FIG. 1 is a diagrammatically lateral cross-section view of a heat transmitting tube in a combustion furnace of a boiler.

FIG. 1 shows a lateral cross-section of a steel heat transmitting tube constituting a combustion chamber of a heavy oil burning boiler. Heat transmitting tubes 1 are weld-joined 3 to each other through plate-shaped elongate fins 2 to form a panel-shaped heat transmitting tube 21 as a whole. As shown in this figure, an outer surface of the heat transmitting tube 21 is divided into a combustion chamber side and a furnace wall side. The form (combustion chamber side) is subjected to a strong radiant heat through a high temperature combustion gas and directly contacts with combustion gas and burnt product (burnt ash), so that it is subjected to corrosion action through the gas and burnt ash. On the other hand, the latter or the outer surface of the heat transmitting tube facing the furnace wall prevents heat dissipation through a heat insulating material 4 and further is protected by a thin steel casing 5 located at the outside thereof.

And also, an inner wall face of the heat transmitting tube is strongly subjected to an influence of the above exterior environment. That is, the inner wall face 6 of the heat transmitting tube as a heat transmitting surface facing the combustion gas side is heated by a strong heat flow fed from an exterior, so that the boiler water is heated, boiled and evaporated.

Through the process of such heating, boiling and evaporating phenomena, there are caused ① concentration of alkali component included in the boiler water and corrosion action based thereon;

② precipitation and adhesion of a slight amount of a dissolved element such as Ca, Mg, Fe, Si, P, Cu and the like or a compound thereof included in the boiler water;

③ temperature rise of tube wall through growth of deposition having a large resistance to heat transmission based on a long period of the above phenomenon ②;

④ concentration of alkali component in a local peeled portion of the deposition and corrosion action based thereon;

⑤ occurrence of local over-heating through evaporation and vaporization of the boiler water penetrated into a crack portion of the deposition, over-heating of the heat transmitting tube accompanied therewith, occurrence of cracks and breakage through spraying;

⑥ formation of oxide film scale having a low thermal conductivity through over-heating of the heat transmitting tube itself, and the like.

As a cause of forming the deposition produced on the inner wall face of the heat transmitting tube, there are considered (a) evaporation residue of elements and compounds dissolved in the boiler water;

(b) precipitate of fine colloidal substances included in the boiler water; and (c) iron oxide produced through reaction between material of the heat transmitting tube and high temperature boiler water.

This deposition is low in thermal conductivity and acts as a large resistor to a heat flow from the combustion gas at the heat transmitting surface. For example, it is considered that in the case of forming iron oxide of 0.010 mm in thickness, the tube wall temperature in the heat transmitting surface of the heat transmitting tube rises about 60° C., while in the case of forming magnesium phosphate of 0.010 mm in thickness, the tube wall temperature of the heat transmitting surface rises about 82° C.

In the invention, it has been noticed that a porous sprayed coating is formed on the outer surface of the heat transmitting tube, particularly heat transmitting surface 21*a* of the evaporation tube as means for preventing the precipitation of the deposition to control the growth thereof as previously mentioned. That is, the invention is a technique in which corrosion problems produced in the inner wall portion of the heat transmitting tube through the boiler water is indirectly prevented by covering an outer surface of the tube or a heat transmitting surface as a portion directly exposed to combustion gas with a sprayed coating. The structure of the sprayed coating formed under the above object and the method of forming the same will be described below.

Figure 2:
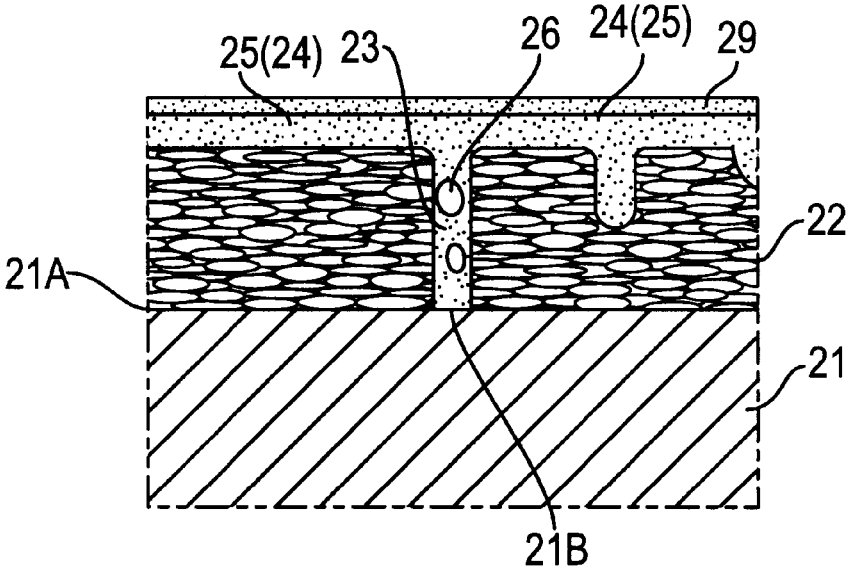
FIG. 2 is a diagrammatic cross-section view illustrating a state of covering and penetrating inorganic sintered fine particles on a surface of a sprayed coating formed onto a surface of a heat transmitting tube in a combustion furnace of a boiler and into pores of the sprayed coating.

FIG. 2 diagrammatically shows a state of microscopically observing a cross-section when a metallic sprayed coating 22 is formed on a heat transmitting surface 21*a* of a heat transmitting tube 21. The sprayed coating 22 has a structure in which combustion gas or combustion ash including vanadium oxide or sulfur oxide is liable to penetrate into the inside of the coating because there are many opening pores 23 at the tube wall. Therefore, even when the material for the porous sprayed coating 22 itself is an excellent corrosion-resistant material, the material of the heat transmitting tube in a portion contacting with the pore is corroded by corrosive component penetrated through the opening pores 23, so that it is required to seal the pore with a sealing agent having corrosion resistance. Moreover, numeral 29 in the figure shows a topcoat formed if necessary.

That is, combustion ash of heavy oil, particularly combustion ash inclusive of vanadium compound having a strong corrosiveness lowers a melting point (for example, melting point of $V_2O_5$ is 690° C., and melting point of $5Na_2O.V_2O_4.11V_2O_5$ is 535° C.) to cause fluidizability when oxygen is existent in the atmosphere, so that it easily penetrates into the inside of the sprayed coating 22 through the pores 23 under an operation of the boiler to cause reactions shown by the following equations, whereby the surface of the heat transmitting tube and the sprayed coating 22 itself are corroded.

$$V_2O_5+M \rightarrow MO+V_2O_4$$

$$V_2O_5+M \rightarrow MO_2+V_2O_3 \text{ (M is a metallic element)}$$

In the invention, the porous metal sprayed coating 22 is subjected to working for the formation of the opening pores 23 and the resulting opening pores 23 are positively utilized. That is, in the sprayed coating 22 according to the invention, many pores 23 are formed and inorganic sintered fine particles 25 consisting essentially of vanadium compound and sulfur compound are penetrated and solidified therein to form a heat shielding layer.

In the invention, the inorganic sintered fine particles 25 to be penetrated into the opening pores preferably include vanadium compound such as $V_2O_5$, $Na_2VO_3$, $Na_2O.V_2O_5$ or the like and sulfur compound such as $Na_2SO_4$, $K_2SO_4$ or the like as a main component and contain NiO and a crust-forming component such as $SiO_2$, $Al_2O_3$, $TiO_2$ and $Fe_2O_3$ as an inevitable inclusion. In order to form the heat shielding layer by using the inorganic sintered fine particles 25, it is necessary that the inorganic sintered fine particles 25 having the aforementioned components are applied 24 onto the sprayed coating and further penetrated into the opening pores 23 and sintered by heating to solidify the fine particles.

However, it has been confirmed from the inventors' studies that after the sprayed coating having a given porosity (2–20%) is formed on the surface of the heat transmitting tube, when the sprayed coating 22 is contacted with high-temperature combustion gas produced in the burning of a fossil fuel in the boiler furnace, sintered fine particles as a solid combustion product produced by condensation, precipitation or impact adhesion of components constituting the combustion gas onto the outer wall face of the tube, i.e., the combustion ash in the boiler, develop the heat shielding action.

Namely, as a preferable embodiment of the invention, there is used a heat transmitting tube for the boiler formed by covering the surface of the sprayed coating 22 with the combustion ash in the boiler and filling the opening pores 23 therewith. Thus, there can be prevented not only the corrosion action of the at the outer surface heat transmitting tube for the boiler in contacting the combustion gas in the boiler furnace, but also the corrosion phenomenon caused at the heat transmitting surface 21*a* of the heat transmitting tube 21 and formation and depositing phenomenon of the deposition.

This embodiment will be described in detail below.

In the invention, $V_2O_5$ contained in the inorganic sintered fine particles 25 to be penetrated into the opening pores 23 of the sprayed coating 22, i.e., combustion ash 24 having the same constituting components, is reduced to change into lower oxides of $V_2O_3$, $V_2O_4$ after the corrosion reaction. Since the melting point of these lower oxides is about 1900° C., they are solids during the operation of the boiler. In these oxides, the moving rate of oxygen ion, vanadium ion, sodium ion, or sulfur ion resulting from the sulfur compound included in the combustion ash is extremely lowered, so that the corrosion reaction actually stops. And also, these solidified lower oxides are low in thermal conductivity as compared with the fused state and contain many bubbles 26, so that they develop the heat shielding action and create the same function and effect as in the aforementioned inorganic sintered fine particles.

According to the inventors' studies, it has been confirmed that the heat shielding action of the above coating is not a mere heat insulating action but the lamination structure peculiar to the sprayed coating plays an effective role. That is, the sprayed coating 22 has a structure of gathering fine flattened particles as shown in FIG. 2, so that when heat flows from the exterior passes through the coating, contact portions between the particles are a resistor to thermal conduction. As seen from the lamination structure of the particles shown in FIG. 2, therefore, the passing heat easily proceeds in a lateral direction having a smaller contact interface between the particles rather than a vertical direction in the sprayed coating.

In this connection, it has been confirmed from the inventors' investigations that the thermal conduction of the sprayed coating has an anisotropy of about 1:2.3 in the vertical direction to lateral direction. Therefore, when the sprayed coating including the combustion ash is existent, on the surface of the heat transmitting tube, the action of receiving heat of the combustion gas is equalized over a full surface of the heat transmitting tube in the axial direction thereof. This effect controls heat flowing locally and extremely produced in the inner face of the heat transmitting tube and prevents over-heating even when the deposition formed on the inner wall face of the heat transmitting tube is locally peeled, which serves to prevent breakage of the tube under jetting.

Figure 3:
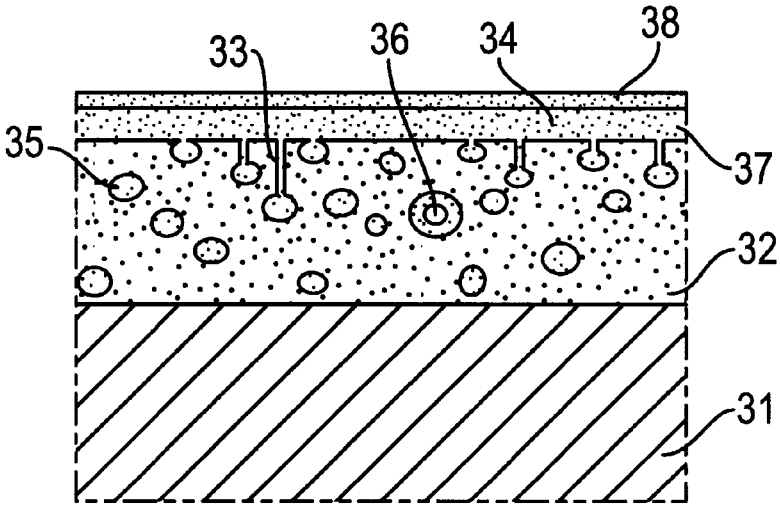
FIG. 3 is a diagrammatic cross-section view illustrating a state of penetrating a combustion ash of a heavy oil into a porous portion of a sprayed coating formed on the surface of the heat transmitting tube.

Moreover, FIG. 3 diagrammatically shows a case in which the opening pores arriving at the surface of the surface of the heat transmitting tube 31 do not exist in the sprayed coating 32. If the opening pores 33 connecting to outer surface are existent in the sprayed coating 32, the combustion ash 34 penetrates into the inside of the pores 33 and is solidified therein. Even in this case, the heat shielding layer is produced on the surface and hence excessive heat loading to the heat transmitting tube can be controlled.

For example, when 50% Ni—50% Cr alloy is sprayed onto the outer heat receiving surface of the heat transmitting tube, the thermal conductivity of the resulting coating is about $10–12\times10^{-1}$ cal/cm.°C·s. However, when combustion ash of heavy oil penetrates into the pores of the sprayed coating to form a heat shielding layer during the operation of the boiler, the thermal conductivity becomes not more than $2\times10^{-1}$ cal/cm.°C·s. When the combustion ash containing bubbles 36 of the combustion gas component penetrates and solidifies in the surface of the sprayed coating, the thermal conductivity further lowers.

And also, porous dusts (unburnt carbon) having a small bulk density as a topcoat 29, 38 are adhered to the outermost surface portion of the combustion ash, which develop the heat shielding action.

In the invention, it is necessary that the material of the sprayed coating has excellent heat resistance and corrosion resistance as compared with the kind of steel for the heat transmitting tube. For example, metal·alloys containing Fe, Cr, Ni, Al or the like as a main component such as 13% Cr steel, 18–25% Cr steel, 80% Ni—20% Cr, 90% Ni—10% Al, 50% Ni—50% Cr and the like are preferable. And also, these metal·alloys may be added with a metal such as Ti, Nb, Y, V, Mo or the like or an alloy thereof, or a self-fluxing alloy defined in JIS H8303 may be used.

In the invention, the thickness of the sprayed coating covering the surface of the heat transmitting tube is within a range of 30 $\mu$m–1000 $\mu$m, preferably 100–500 $\mu$m. When the thickness is less than 30 $\mu$m, it is liable to become ununiform in the spot operation at the inside of the boiler furnace, while when it exceeds 1000 $\mu$m, a long time is uneconomically taken in the working. In any case, peeling is liable to be caused.

And also, the sprayed coatings 22, 32 covering the surface of the heat transmitting tube according to the invention are required to have a high porosity. In the invention, it is possible to apply a sprayed coating having a porosity of about 1–20%, but a sprayed coating having a porosity of about 2–10% is favorable.

As the spraying method, use may be made of a spraying method applicable in the boiler furnace, such as plasma spraying method, electric arc spraying method, flame spraying method, high-speed flame spraying method or the like.

Although the object of the invention can sufficiently be attained even when the sprayed coating is a single layer of a metal sprayed coating, use may be made of a sprayed coating having a two-layer structure wherein the following oxide ceramic is sprayed as a topcoat 38. In this case, according to the invention, the oxide ceramic sprayed coating constituting the topcoat 38 is required to be porous and have a structure in which the combustion ash component can be penetrated through pores into the inside of the coating as previously mentioned. Moreover, as the oxide ceramic, there are preferably used materials of $ZrO_2$, $Cr_2O_3$, $Cr_2O_3$—$SiO_2$, $ZrO_2$—$SiO_2$ and the like which are added with $Al_2O_3$, $Al_2O_3$—$TiO_2$, $Al_2O_3$—MgO, $Y_2O_3$, CaO, MgO, $CeO_2$ and the like.

In another embodiment of the invention, the sprayed coating may be a composite coating of three-layer structure wherein an overcoat 37 of an oxide cermet formed by spraying a mixture of a metal and the above oxide ceramic as a middle layer is formed on the metallic sprayed coating 22, 32 as an undercoat and further an oxide ceramic sprayed layer as an outermost topcoat 38 is formed on the overcoat 37. Even in this case, the presence of the opening pores 23, 33 is necessary for facilitating the penetration of the inorganic sintered fine particles 25 or combustion ash 24 into the sprayed coating.

As mentioned above, the porous sprayed coating favorably used in the invention is a composite coating of an undercoat 22, 32 formed by spraying a metal·alloy having excellent high temperature oxidation resistance and corrosion resistance at high temperature as compared with the material for the heat transmitting tube so as to have a thickness of 30–1000 μm and a porosity of 2–20% and a coat formed by spraying one or more of oxide ceramics selected from $ZrO_2$, $Al_2O_3$, $SiO_2$, MgO, $TiO_2$ and $Y_2O_3$ or an oxide cermet thereof onto the undercoat so as to have a thickness of 100–500 μm and a porosity of 2–20%.

Further, the porous sprayed coating according to the invention is comprised of an undercoat 22, 32 formed by spraying a metal·alloy having excellent high temperature oxidation resistance and corrosion resistance at high temperature as compared with the material for the heat transmitting tube so as to have a thickness of 30–1000 μm and a porosity of 2–20%, an overcoat 37 formed by spraying a oxide cermet consisting of the metal·alloy for the undercoat and one or more oxide ceramics selected from $ZrO_2$, $Al_2O_3$, $SiO_2$, MgO, $TiO_2$ and $Y_2O_3$ onto the undercoat, and a topcoat 38 formed by spraying one or more oxide ceramics selected from $ZrO_2$, $Al_2O_3$, $SiO_2$, MgO, $TiO_2$ and $Y_2O_3$ thereonto.

In the invention, the heat transmitting tube for the boiler having excellent effect of controlling the adhesion of the deposition onto the inner wall of the tube can be produced by spraying a metal·alloy having excellent oxidation resistance and corrosion resistance at high temperature as compared with the material for the heat transmitting tube onto a heat transmitting surface 21*a* contacting combustion gas so as to have a thickness of 30–1000 μm and a porosity of 2–20%, and then contacting a gas containing vanadium compound and sulfur compound as a main component with the resulting porous sprayed coating to impregnate inorganic sintered material containing vanadium compound such as $V_2O_5$, $Na_2VO_3$, $Na_2O.V_2O_5$ and sulfur compound such as $Na_2SO_4$, $K_2SO_4$ as a main component and including NiO and a crust-forming component such as $SiO_2$, $Al_2O_3$, $TiO_2$ and $Fe_2O_3$ as an inevitable inclusion in pores 23, 33 of the coating and thinly cover the surface of the coating to form a heat shielding layer.

In the above production method, the material for the porous sprayed coating and the method of forming the sprayed coating are as mentioned above. Moreover, it is favorable that the heat shielding layer of the sprayed coating is formed by contacting the sprayed coating with the combustion gas in the boiler to penetrate and solidify the fine particulate combustion ash contained in the combustion gas in the pores of the coating.

As mentioned above, according to the invention, it is possible that the sprayed coating having the heat shielding layer is formed on the outer surface of the heat transmitting tube such as an evaporation tube in the burning furnace, heating tube or the like in various boilers, whereby corrosion through the combustion gas and combustion ash is decreased and excessive heat flow flowing into the heat transmitting tube is prevented to control the phenomenon of adhering the deposition onto the inner wall face of the heat transmitting tube or oxidizing the material of the tube itself.

Furthermore, the above action and effect mitigate the corrosion action through boiler water component due to over-heating of the evaporation tube, and breakage under jetting due to over-heating of the tube wall temperature of the evaporation tube is prevented, and also the number of chemical cleanings for removing the deposition on the inner wall face of the evaporation tube is decreased. Therefore, the invention significantly contributes to the maintenance of the boiler, safety, and cost savings.

EXAMPLES

Example 1

In this example, the following sprayed coating is formed on a heat receiving portion of an evaporation tube in a boiler for power generation burning heavy oil, and then an effect of decreasing the adhesion of deposition onto the inner wall face of the evaporation tube is examined.

(1) Boiler to be Tested

① boiler type: single drum radiant reheating system

② steam pressure: outlet of super heater (128 kgf/cm$^2$), outlet of reheater (33 kgf/cm$^2$)

③ steam temperature: outlet of super heater (540° C.), outlet of reheater (540° C.)

④ steam quantity: 453 t/h

⑤ water treating process: treatment with phosphate according to JIS B8223

⑥ fuel: heavy oil (S: 0.8–1.5%, V: 15–35 ppm, Na: 5–15 ppm)

(2) Specification and Forming Site of Sprayed Coating

① formation by plasma spraying 50% Ni—50% Cr alloy at a thickness of 300 μm (porosity: 5–8%)

② formation of plasma spraying MSFNi2 alloy according to JIS H8303 at a thickness of 300 μm (porosity: 3–10%)

③ formation of 8% $Y_2O_3$.92% $ZrO_2$ alloy on the alloy coating of the above ① at a thickness of 300 μm (porosity: 12–18%)

The above sprayed coating is formed over about 10 m in up and down directions around a center of an outer surface portion having a highest heat loading in the evaporation tube.

(3) Evaluation Method

Since the effect of the sprayed coating can not be distinguished from an appearance observation, the sprayed coating formed tube and the evaporation tube adjacent thereto are taken out in the periodical inspection of the boiler conducted 2–3 years after the start of the operation and the quantity of the deposition adhered to the inner wall face is measured to judge the effect.

At the same time, the change of the property in the sprayed coating formed on the outer surface of the evaporation tube and the melting point of the combustion ash adhered thereto are examined.

(4) Table 1 shows a relation quantity of the deposition adhered to the inner wall face of the evaporation tube and evaporation quantity of boiler water.

In the inner wall face of the non-treated evaporation tube not forming the sprayed coating, the deposition consisting essentially of iron oxide ($Fe_3O_4$), nickel oxide (NiO), zinc oxide (ZnO), phosphoric acid ($P_2O_5$) and the like in accordance tends to increase with the increase of the steam quantity of the boiler water, and the quantity of the deposition arrives at 20–40 mg/cm$^2$ after 15 t×10$^6$ (No. 4, 5). On the contrary, the quantity of the deposition in the inner wall face of the evaporation tube (No. 1, 2, 3) formed with the sprayed coating stops at 10–20 mg/cm$^2$ even after evaporation of 15 t×10$^6$, from which it is guessed that the excessive heat flow into the evaporation tube is prevented by the presence of the sprayed coating to reduce the phenomenon of precipitating and adhering the deposition from the boiler water to the inner wall face of the tube.

And also, the combustion ash of heavy oil consisting essentially of vanadium ($V_2O_5$, $NaVO_3$) and sodium sulfate ($Na_2SO_4$) completely covers the sprayed coating and a part thereof penetrates into pores of the sprayed coating, so that corrosion loss of the coating is slight. Furthermore, it has been confirmed that in case of forming a ceramic coating on the metal sprayed coating (No. 3), the upper layer coating is locally peeled, but the lower layer coating is maintained at a sound state.

Moreover, when measuring melting points of the combustion ash adhered to the outermost layer portion of the sprayed coating and the combustion ash penetrated into the pore, the former is 530–565° C. and the latter (taken out from No. 1, 2, 3 in Table 1) is not lower than 1000° C. and it has been confirmed that both are rendered into a high melting point.

TABLE 1

| | Sprayed coating | | Adhesion quantity of deposition on inner face of evaporation tube ($mg/cm^2$) | | | |
|---|---|---|---|---|---|---|
| No. | material | thickness ($\mu m$) | after $5 \times 10^6$ t | after $10 \times 10^6$ t | after $15 \times 10^6$ t | Remarks |
| 1 | 50 Ni—50 Cr | 300 | 5~8 | 7~14 | 10~17 | Acceptable |
| 2 | MSFNi2 | 300 | 6~12 | 8~15 | 10~18 | Example |
| 3 | 8 $Y_2O_3$—92 $ZrO_2$ on 50 Ni—50 Cr | 600 | 5~8 | 10~13 | 11~15 | |
| 4 | none | — | 8~20 | 12~30 | 20~40 | Comparative Example |

(Note)
(1) Material of evaporation tube is STBA12
(2) Numerical value in the column "material of sprayed coating" is % by weight.

Example 2

In this example, there is examined an effect on controlling a growth rate of oxide scale produced in the inner wall face of the heating tube for the boiler tested in Example 1 provided on the outer surface with the sprayed coating (oxide film produced by reaction between high temperature steam and material of the heating tube).

(1) Boiler to be tested: same as in Example 1

(2) Spraying specification: same as in Example 1

(3) Spraying place: outer surface of the heating tube (material for the tube SUS 321HTB)

(4) Evaluation method:

The evaluation is carried out by cutting the heating tube in the periodical inspection of the boiler conducted after the start of the operation and measuring the thickness of oxide scale produced on the inner wall face of the tube.

Results

Table 2 shows results examined on the thickness of the oxide scale produced on the inner wall face of the heating tube. As shown in this table, the thickness of the oxide scale in the heating tube not covered with the sprayed coating is 0.13 mm after 35000 hours and arrives at 0.21 mm after 87000 hours, while that in the tube covered with the sprayed coating according to the invention is 0.09–0.11 mm and 0.14–0.17 mm after the given operating times, respectively, from which it has been confirmed that the formation of the sprayed coating controls the growing rate of the steam oxide scale.

Moreover, the outer surface of the heating tube is subjected to high temperature corrosion action through the adhesion of combustion ash of heavy oil, so that the corrosion loss of 0.2–0.3 mm is observed in SUS 321HTB per 10000 hours, but the sprayed coating remains in the spraying place even after 87000 hours and signs corrosion are not observed in the heating tube, from which it has been confirmed that the sprayed coating prevents corrosion on the outer surface of the tube.

TABLE 2

| | Sprayed coating | | Thickness of steam oxide scale (mm) | | |
|---|---|---|---|---|---|
| No. | material | thickness ($\mu m$) | after 35,000 h | after 87,000 h | Remarks |
| 1 | 50 Ni—50 Cr | 300 | 0.08 | 0.15 | Accept- |
| 2 | MSFNi2 | 300 | 0.08 | 0.15 | able |
| 3 | 8 $Y_2O_3$—92 $ZrO_2$ on 50 Ni—50 Cr | 600 | 0.07 | 0.13 | Example |
| 4 | none | — | 0.13 | 0.21 | Compara-tive Example |

(Note)
(1) Material of heating tube is SUS 321HTB
(2) Numerical value in the column "material of sprayed coating" is % by weight.

Example 3

In this example, the effect of reducing the adhesion of deposition onto an inner wall face of a tube is examined when the sprayed coating is formed in an evaporation tube of a boiler burning natural gas.

(1) Boiler to be Tested

① Boiler type: single drum radiant reheating system

② Steam pressure: outlet of super heater (250 $kgf/cm^2$), outlet of reheater (45 $kgf/cm^2$)

③ steam temperature: outlet of super heater (540° C.), outlet of reheater (566° C.)

④ evaporation quantity: 1,600 t/h

⑤ water treating process: according to JIS B8223

⑥ fuel: liquefied natural gas (2) Specification and Forming Site of Sprayed Coating ① formation by high velocity oxygen fuel (HVOF) spraying 80% Ni—20% Cr alloy at a thickness of 300 $\mu m$ (porosity: 2~5%)

② formation by plasma spraying 8% $Y_2O_3$—92% $ZrO_2$ ceramic on the alloy of the item ① at a thickness of 250 μm (porosity: 8–20%)

The above sprayed coating is formed over about 10 m in up and down directions around a center of an outer surface portion having a highest heat loading in the evaporation tube.

(3) Evaluation Method

It is the same as in Example 1.

(4) The results are shown in Table 3. As shown in this table, the formation of the deposition is observed in the inner wall face of the evaporation tube even in this tube directly exposed to a gas containing no corrosive component such as natural gas fuel. On the contrary, in the inner wall face of the evaporation tube covered with the sprayed coating, the adhesion quantity of the deposition is observed to be 45–60% of that in the non-treated evaporation tube. In the case of forming an oxide ceramic layer (No. 2), the adhesion quantity of the deposition is particularly controlled to not more than 50%, which shows the effect of reducing the deposition forming rate on the inner wall face of the evaporation tube by the sprayed coating even in the natural gas burning boiler.

The formation of the sprayed coating has not been required in the natural gas burning boiler because corrosiveness and erosion action of dust are not existent in the combustion gas. However, as seen from this example, the formation of the deposition on the inner wall face of the evaporation tube is controlled by not only the sprayed coating having the oxide ceramic layer but also the metal sprayed coating alone. In the metal sprayed coating, it is considered that opening pore portion in the vicinity of the surface of the coating exposed to a higher temperature is rendered into a closed state by promotion of oxidization through the combustion gas having a great amount of steam component and hence bubbles in the inside of the coating develops a heat shielding effect.

And also, it is considered to include an effect of controlling the high concentration of heat flow by anisotropy of thermal conduction resulted from the lamination of flat particles inherent to the sprayed coating.

TABLE 3

| Sprayed coating | | | Adhesion quantity of deposition on inner face of evaporation tube (mg/cm²) | |
|---|---|---|---|---|
| No. | material | Thickness (μm) | after 15 × 10⁶ t | Remarks |
| 1 | 50 Ni—50 Cr | 300 | 11~23 | Acceptable Example |
| 2 | 8 $Y_2O_3$—92 $ZrO_2$ on 50 Ni—50 Cr | 600 | 8~13 | |
| 3 | none | — | 18~38 | Comparative Example |

(Note)
(1) Material of evaporation tube is STBA12
(2) Numerical value in the column "material of sprayed coating" is % by weight.

Example 4

In this example, the adhesion quantity of the deposition on the inner wall face of the evaporation tube is examined when the sprayed coating according to the invention is applied to the evaporation tube of the boiler burning heavy oil in the operation by adding Mg compound (MgO) as a corrosion inhibitor to the heavy oil for preventing high-temperature corrosion due to vanadium compound, sulfur compound or the like included in combustion ash.

(1) Boiler to be Tested

① Boiler type: single drum radiant reheating system

② Steam pressure: outlet of super heater (268 kgf/cm²), outlet of reheater (46 kgf/cm²)

③ steam temperature: outlet of super heater (541° C.), outlet of reheater (566° C.)

④ evaporation quantity: 1,500 t/h

⑤ water treating process: according to JIS B8223

⑥ fuel: heavy oil (vanadium: 60–70 ppm, sulfur: 1.5–1.8 wt %)

⑦ corrosion inhibitor: MgO fine powder is added to the heavy oil at a weight ratio of Mg/V=0.6 to vanadium content. In the operation, $Mg(OH)_2$ may be used instead of MgO (2) Specification and Forming Site of Sprayed Coating The coating of 50% Ni—50% Cr alloy is formed over about 10 m in up and down directions around a center of an outer surface portion having a highest heat loading in the evaporation tube at a thickness of 100 μm, 200 μm or 300 μm. (porosity of the coating: 2–8%)

(3) Evaluation Method

The evaporation tube is taken out in the periodical inspection likewise Example 1 to measure a quantity of deposition adhered to the inner wall face.

(4) The results are shown in Table 4 in relation to the evaporation tube of the boiler. In the non-treated evaporation tube as a comparative example (No. 4, 5), the deposition is adhered and deposited in a quantity of 30–51.5 mg/cm², while a deposition quantity of 12.5–26.1 mg/cm² is observed in the formation of the sprayed coating onto the surface of the tube (No. 1–3), from which the effect of the sprayed coating is recognized.

Furthermore, there is no great difference in the effect of the sprayed coating when the thickness is within a range of 100–300 μm. Moreover, it has been confirmed that even when Mg compound is incorporated in the combustion ash as a corrosion inhibitor, the sprayed coating prevents excessive heat flow to the evaporation tube and hence the adhesion and deposition rates of the deposition are controlled.

TABLE 4

| Sprayed coating | | | Adhesion quantity of deposition on inner face of evaporation tube (mg/cm²) | |
|---|---|---|---|---|
| No. | material | Thickness (μm) | after 20 × 10⁶ t | Remarks |
| 1 | 50 Ni—50 Cr | 300 | 12.5~24.2 | Acceptable Example |
| 2 | 50 Ni—50 Cr | 200 | 13.5~25.6 | |
| 3 | 50 Ni—50 Cr | 100 | 15.0~26.1 | |
| 4 | none | — | 30.2~51.5 | Comparative Example |
| 5 | none | — | 38.7~48.8 | |

(Note)
(1) Material of evaporation tube is STBA24
(2) Numerical value in the column "material of sprayed coating" is % by weight.

Example 5

Various combustion ashes adhered onto the outer surface of the evaporation tube in the boiler burning heavy oil are sampled and adhered onto a sprayed coating of Ni—Cr alloy formed on a test plate (SUS410, width 50×length 100× thickness 5 mm), which is heated to 550° C., whereby the combustion ashes are penetrated into opening pores of the sprayed coating. Thereafter, the thermal conductivity of the test plate is measured. As a comparative example, there is provided a sprayed coating not adhered with the combustion ash.

Table 5 shows chemical analysis results of the combustion ashes sampled from the evaporation tube of the heavy oil burning boiler used in this example, each of which ashes has the following features.

(Column A) combustion ash: After heavy oil containing 30–60 ppm of vanadium as $V_2O_5$ and 0.8–1.4 wt % of sulfur is continuously burnt for about 4000 hours, the ash is sampled and has a melting point of 550–610° C.

(Column B) combustion ash: After heavy oil containing 10–25 ppm of vanadium as $V_2O_5$ and 0.5–0.8 wt % of sulfur is continuously burnt for about one year, the ash is sampled and has a melting point of 520–620° C.

(Column C) combustion ash: After heavy oil containing 100–160 ppm of vanadium as $V_2O_5$ and 2.1–2.3 wt % of sulfur and added with $Mg(OH)_2$ for preventing the high temperature corrosion action of vanadium is continuously burnt for about six months, the ash is sampled, which has a very large magnesium content as compared with the other combustion ashes and a melting point of not lower than 1000° C.

Table 6 shows results of thermal conductivity measured on the coating of the test plate. As seen from the results, the thermal conductivity of the coating adhered with the combustion ash and impregnated by heating is fairly small as compared with that of the coating in the comparative example (No. 4) and the resistance to heat transmission becomes large. Particularly, the coating covered with combustion ash (C) (No. 3) is lowest in the thermal conductivity, which is considered to be due to the content of MgO as a thermal conduction resisting body included in the combustion ash.

Moreover, when the cut section of the coating in the test plate (No. 1, 2) after the heating at 550° C. is examined by means of an optical microscope, the presence of combustion ash component penetrated from the pores of the coating is clearly observed.

TABLE 5

| Chemical component (wt %) | A heavy oil none | B heavy oil none | C heavy oil · residual oil Mg-based additive |
|---|---|---|---|
| unburnt carbon | 0.02~0.05 | 0.10~0.12 | 0.01~0.05 |
| sulfur (as $SO_3$) | 17.5~24.4 | 30.5~46.0 | 3.8~7.8 |
| iron (as $Fe_2O_3$) | 7.8~10.1 | 4.5~8.9 | 2.5~4.4 |
| vanadium (as $V_2O_5$) | 30.7~42.9 | 15.0~18.5 | 22.0~25.0 |
| nickel (as NiO) | 4.6~6.1 | 3.2~5.5 | 5.6~8.9 |
| sodium (as $Na_2O$) | 9.1~12.5 | 16.7~23.5 | 2.0~5.1 |
| calcium (as CaO) | 0.57~0.92 | 0.8~1.2 | 2.8~5.5 |
| magnesium (as MgO) | 0.21~0.74 | 0.3~0.9 | 30.1~38.2 |
| silicon (as $SiO_2$) | 0.51~0.81 | 1.5~3.5 | 0.5~0.8 |
| potassium (as $K_2O$) | 2.1~3.5 | 3.9~4.4 | 0.7~0.9 |
| melting point (° C.) | 550~610 | 520~620 | not less than 1000 |

TABLE 6

| No. | Material of sprayed coating | presence or absence of combustion ash | Thermal conductivity (cal/cm · ° C. · s) 25° C. | 300° C. | Remarks |
|---|---|---|---|---|---|
| 1 | 80 Ni—20 Cr | presence (A) | 1.1~1.5 | 1.3~1.8 | Accept-able |
| 2 | 80 Ni—20 Cr | presence (B) | 1.2~1.9 | 1.3~2.0 | |

TABLE 6-continued

| No. | Material of sprayed coating | presence or absence of combustion ash | Thermal conductivity (cal/cm · ° C. · s) 25° C. | 300° C. | Remarks |
|---|---|---|---|---|---|
| 3 | 80 Ni—20 Cr | presence (C) | 0.7~2.1 | 0.8~2.3 | Example |
| 4 | 80 Ni—20 Cr | absence | 10~12 | 11~13 | Comparative Example |

(Note)
(1) Numerical value in the column "material of sprayed coating" is % by weight.
(2) (A), (B) and (C) in the column "combustion ash" are ashes defined in Table 5.
(3) Quantity of combustion ash applied onto the sprayed coating is 20 mg/l $cm^2$.
(4) Heating conditions in an electric furnace after the application of combustion ash are 550° C. × 1 hour.

Industrial Applicability

The invention is applied to a heat transmitting tube, particularly an evaporation tube for a boiler burning heavy oil such as heavy oil, petroleum, coke or the like or a mixture with coal or the like, an evaporation tube for combined plant boiler utilizing gas turbine combustion gas, an evaporation tube for a boiler recovering waste heat from a town garbage burning plant, and the like.

Further, the invention comprises a technique effective for controlling the formation and growth of oxide scale produced on an inner face of an evaporation for boiler contacting with an over-heated steam.

What is claimed is:

1. A coated heat transmitting tube for a boiler, comprising:

a tube having a heat transmitting surface for facing combustion gas;

a porous sprayed coating on the heat transmitting surface of the tube; and a heat shielding layer formed by impregnating pores of the porous coating with inorganic sintered fine particles comprising vanadium compound and sulfur compound.

2. The coated heat transmitting tube of claim 1, further comprising a covering on the impregnated porous coating.

3. The coated heat transmitting tube of claim 1, wherein the porous sprayed coating is formed by subjecting a metal·alloy having higher high temperature oxidation resistance and corrosion resistance at high temperature as compared with a material of the heat transmitting tube to thermal spraying such that the porous sprayed coating has a thickness of 30–1000 μm and a porosity of 2–20%.

4. The coated heat transmitting tube of claim 1, wherein the porous sprayed coating comprises a composite coating having a thickness of 100–1000 μm and a porosity of 2–20%, and wherein the composite coating comprises:

an undercoat formed by thermal spraying of a metal·alloy having higher high temperature oxidation resistance and corrosion resistance at high temperature as compared with a material of the heat transmitting tube; and a topcoat thermally sprayed onto the undercoat, the topcoat comprising at least one oxide ceramic or oxide cermet selected from $ZrO_2$, $Al_2O_3$, $SiO_2$, MgO, $TiO_2$, and $Y_2O_3$.

5. The coated heat transmitting tube of claim 1, wherein the porous sprayed coating comprises a composite coating having a thickness of 100–1000 μm and a porosity of 2–20%, and wherein the composite coating comprises:

an undercoat formed by thermal spraying of a metal·alloy having higher high temperature oxidation resistance and corrosion resistance at high temperature as compared with a material of the heat transmitting tube;

an overcoat thermally sprayed onto the undercoat, the overcoat comprising at least one oxide ceramic or oxide cermet selected from $ZrO_2$, $Al_2O_3$, $SiO_2$, MgO, $TiO_2$, and $Y_2O_3$; and a topcoat thermally sprayed onto the overcoat, the topcoat comprising at least one oxide ceramic selected from $ZrO_2$, $Al_2O_3$, $SiO_2$, MgO, $TiO_2$, and $Y_2O_3$.

6. The coated heat transmitting tube of claim 1, wherein the inorganic sintered fine particles comprise vanadium compound, sulfur compound, NiO, and crust-forming component.

7. The coated heat transmitting tube of claim 6, wherein the vanadium compound comprises at least one of $V_2O_5$, $NaVO_3$, and $Na_2O.V_2O_5$.

8. The coated heat transmitting tube of claim 6, wherein the sulfur compound comprises at least one of $Na_2SO_4$ and $K_2SO_4$.

9. The coated heat transmitting tube of claim 6, wherein the crust-forming component comprises at least one of $SiO_2$, $Al_2O_3$, $TiO_2$, and $Fe_2O_3$.

10. The coated heat transmitting tube of claim 1, wherein the sintered fine particles comprise a solid combustion product, the sintered fine particles being produced by concentration, precipitation, or impinge adhesion when a fossil fuel is burned in the boiler.

11. The coated heat transmitting tube of claim 10, wherein the sintered fine particles of the solid combustion product comprise combustion ash in the boiler.

12. A method of manufacturing a coated heat transmitting tube for a boiler, comprising:

forming a porous sprayed coating by thermally spraying a metal·alloy having higher high temperature oxidation resistance and corrosion resistance at high temperature as compared with a material of a heat transmitting tube onto a heat transmitting surface of the tube for contacting combustion gas; and contacting the porous sprayed coating with a gas comprising vanadium compound and sulfur compound at high temperature to form a heat shielding layer formed by impregnating pores of the porous sprayed coating with inorganic sintered fine particles comprising vanadium compound and sulfur compound.

13. The method of claim 12, wherein the forming of the porous sprayed coating further comprises thermally spraying on to the metal·alloy at least one oxide ceramic or oxide cermet.

14. The method of claim 13, wherein the forming of the porous sprayed coating further comprises thermally spraying on to the at least one oxide or oxide cermet an additional layer of at least one oxide ceramic.

15. A method of manufacturing a coated heat transmitting tube for a boiler having an excellent effect of controlling adhesion of deposition onto an inner wall face of the tube, comprising:

forming a porous sprayed coating having a thickness of 30–1000 $\mu$m and a porosity of 2–20%, the forming of the porous sprayed coating comprising thermally spraying a metal·alloy having higher high temperature oxidation resistance and corrosion resistance at high temperature as compared with a material of the heat transmitting tube onto a heat transmitting surface of the tube for contacting a combustion gas; and then contacting the porous sprayed coating with a gas comprising vanadium compound and sulfur compound at high temperature to form a heat shielding layer formed by impregnating pores of the porous sprayed coating with inorganic sintered fine particles comprising vanadium compound, sulfur compound, NiO, and crust-forming component.

16. The method of claim 15, wherein the vanadium compound of the sintered fine particles comprises at least one of $V_2O_5$ and $Na_2O.V_2O_5$.

17. The method of claim 15, wherein the sulfur compound of the sintered fine particles comprises $Na_2SO_4$.

18. The method of claim 15, wherein the crust-forming component comprises at least one of $SiO_2$, $Al_2O_3$, $TiO_2$, and $Fe_2O_3$.

19. The method of claim 15, wherein the porous sprayed coating comprises a composite coating having a thickness of 100–1000 $\mu$m and a porosity of 2–20% formed by:

thermally spraying the metal·alloy having higher high temperature oxidation and corrosion resistance at high temperature as compared with a material of the heat transmitting tube; and then thermally spraying thereonto at least one oxide ceramic or oxide cermet selected from $ZrO_2$, $Al_2O_3$, $SiO_2$, MgO, $TiO_2$, and $Y_2O_3$.

20. The method of claim 15, wherein the porous sprayed coating comprises a composite coating having a thickness of 100–1000 $\mu$m and a porosity of 2–20% formed by:

thermally spraying the metal·alloy having higher high temperature oxidation resistance and corrosion resistance at high temperature as compared with a material of the heat transmitting tube;

then thermally spraying thereonto at least one oxide ceramic or oxide cermet selected from $ZrO_2$, $Al_2O_3$, $SiO_2$, MgO, $TiO_2$, and $Y_2O_3$; and further thermally spraying thereonto at least one oxide ceramic selected from $ZrO_2$, $Al_2O_3$, $SiO_2$, MgO, $TiO_2$, and $Y_2O_3$.

21. The method of claim 15, wherein the heat shielding layer of the porous sprayed coating is formed by contacting combustion gas in the boiler with the porous sprayed coating to invade and solidify concentration component and fine particulate combustion ash included in the combustion gas in the pores of the porous sprayed coating and adhere them to a surface of the porous sprayed coating so as to form the inorganic sintered fine particles.

* * * * *

UNITED STATES PATENT AND TRADEMARK OFFICE

CERTIFICATE OF CORRECTION

PATENT NO. : 6,082,444
DATED : July 4, 2000
INVENTOR(S) : Y. Harada et al.

It is certified that error appears in the above-identified patent and that said Letters Patent is hereby corrected as shown below:

On the cover of the printed patent, at Item [75], Abstract, line 13, "fin" should be ---fine---.

Signed and Sealed this

Twelfth Day of June, 2001

Nicholas P. Godici

*Attest:*

*Attesting Officer*

NICHOLAS P. GODICI
*Acting Director of the United States Patent and Trademark Office*